United States Patent [19]

Mombelli

[11] Patent Number: 4,672,826

[45] Date of Patent: Jun. 16, 1987

[54] ELECTROMECHANICAL LOCK ACTUABLE SIMULTANEOUSLY BY SEVERAL PROGRAMMABLE CODES, BY ONE OR MORE USERS AND WHOSE ECCENTRIC FOR UNLOCKING THE BOLT IS ECCENTRICALLY MOUNTED DIRECTLY ON THE MOTOR SHAFT

[75] Inventor: Paul Mombelli, Nice, France

[73] Assignee: MER/I.C.B., Sartrouville, France

[21] Appl. No.: 829,609

[22] Filed: Feb. 14, 1986

[30] Foreign Application Priority Data

Feb. 14, 1985 [FR] France ..... 85 02387

[51] Int. Cl.[4] ..... E05B 49/00

[52] U.S. Cl. ..... 70/278; 70/214

[58] Field of Search ..... 70/214, 220, 277, 278, 70/279, 203, 280–282; 301/171, 172; 340/825.31

[56] References Cited

U.S. PATENT DOCUMENTS 3,584,486 6/1971 Trip ..... 70/278
4,038,846 8/1977 Klann ..... 70/278
4,148,092 4/1979 Martin ..... 361/172
4,220,022 9/1980 Willard ..... 70/278

FOREIGN PATENT DOCUMENTS 1911947 9/1970 Fed. Rep. of Germany .
1914724 10/1970 Fed. Rep. of Germany .
2444979 7/1980 France .
2467946 4/1981 France .
2535775 5/1984 France .

*Primary Examiner*—Robert L. Wolfe
*Attorney, Agent, or Firm*—Young & Thompson

[57] ABSTRACT

An electromechanical lock with coded keyboard programmable by several users. The lock is unlocked electrically by an eccentric, actuated by an electric motor, which acts on a trigger to unlock the device. The eccentric is a disk mounted eccentrically on a shaft of the electric motor. The rotation of the shaft causes the disk to turn, which, under the action of centrifugal force, strikes the trigger so as to free the bolt. A disk of plastic material is fixed concentrically with the axis of the motor, and a second disk of suitable mass is mounted on the first disk in an eccentric manner with respect to the shaft.

4 Claims, 6 Drawing Figures

ELECTROMECHANICAL LOCK ACTUABLE SIMULTANEOUSLY BY SEVERAL PROGRAMMABLE CODES, BY ONE OR MORE USERS AND WHOSE ECCENTRIC FOR UNLOCKING THE BOLT IS ECCENTRICALLY MOUNTED DIRECTLY ON THE MOTOR SHAFT

The invention has as an object an electromechanical lock actuable simultaneously by several programmable codes, by one or more users and whose eccentric for unlocking the bolt is eccentrically mounted directly on the motor shaft.

There already exists numerous electric locks with codes. These locks are generally used by a single user, which poses no problem. They are electrically supplied by the general power line, with standby batteries in place if desired.

Considering that these locks are used by a great number of persons, the present locks are inadequate. Thus, for example in a hotel, numerous patrons come and go and use the same lock. It is therefore necessary that the code may be changed very rapidly and that the management have several codes for the different services (maintenance, technical services, etc . . .) The user must be able to change his code himself as many times as he desires to do so. He must be able to change his code only when the door is open.

In hotels, and more generally, in all establishments practicing the changing of rent, keys have always posed serious problems for the managers.

Each door must be provided with a specific key which will be entrusted to the patron during the entire duration of his stay and, accordingly, this key must not be able to open the other doors, and with passkeys which will permit personnel to access rooms for effecting the work of cleaning or maintenance, daily or as needed. Conventional locksmithing has long satisfied this need by proposing hierarchical lock rules, but a patron may make off with his key and an employee may lose his "pass". For security reasons, in the first case, it is necessary to change the core of the door concerned, in the second case, the assembly of cores corresponding to the lost pass key.

This burdensome procedure is simple, but how is it known if a patron, or a dishonest former employee has copied his key before returning it to the Reception?

To avoid the systematic changing of cores, hotels have sought to propose, for several years, locks controlled by badges or magnetic cards. With these materials, these are keys of a new type which are changed frequently, in general for each patron, whereas core replacements are definitely excluded.

This solution is only partial, as it does not prevent a slow and expensive management of the "badge keys" and does not decrease the risks of theft of a simple badge or a pass key badge by an ill-intentioned individual.

Only the complete removal of keys, including all the forms that they may adopt, would resolve the totality of the problems involved. Coded keyboards, which flourish at present on the fronts of buildings and near the doors of lodgings, seem to be able to provide an interesting solution by the suppression of keys which they permit. Nevertheless, their conception does not permit them to respond directly to the specific needs of the hotel. We are going to see why.

In using several numbers for controlling the unlocking of each door, there may be realized a very flexible hierarchization. One number, different for each door, is given to the patron. A second number, common to several doors, will permit the cleaning lady to enter into the rooms of which she has charge. A third number, giving access to all the rooms, will be reserved for the management. One could likewise introduce complementary levels by adding other numbers. The known coded keyboards permit that person to do this correctly, but they must be programmed by one responsible for the totality of their numbers and for this reason impose constraints unacceptable in hotels. In effect, if the numbers of the upper hierarchal levels are less numerous and will not be changed frequently, on the contrary, the numbers intended for the patrons may change every day. The management of numerous secret code numbers which change frequently is very complex, and on the other hand, the user must make considerable efforts of memory to retain a number that he has not chosen.

The lock according to the invention resolves all these inconveniences.

To this effect, the lock with coded keyboard according to the invention, comprises on its interior face a pushbutton which permits programming the secret code of the user for passage and on its exterior face a coded keyboard.

The door may thus be programmed by the user for passage, only when it is open all the way or at least ajar. In addition to the numerals zero to nine and the normal keys of a keyboard, the same keyboard may comprise one or several specific keys.

The specific keys will be used for controlling the opening of the door after having composed the program and/or for programming secret codes for the service. The said lock associates a mechanical lock and an electric lock.

The electric unlocking of the lock uses a means making use of an eccentric, actuated by an electric motor, which acts on the unlocking trigger.

The eccentric is a disk mounted eccentrically on the axis of the electric motor. The rotation of the said shaft causes the disk to turn, which under the action of the centrifugal force, comes to strike the trigger so as to liberate the bolt.

To the disk of plastic material fixed concentrically with the shaft of the motor so as to be integral with it in rotation, a second disk having a sufficient mass is fixed in an eccentric manner with respect to the shaft. Process for use of the lock according to the invention

PROCESS FOR USE OF THE LOCK ACCORDING TO THE INVENTION

1. Process For Use By The Patron:

The patron finds the door of his room unlocked at the beginning of his stay. He must proceed to program his lock according to the instructions given by the text inscribed on the internal face of this former. This method of use will be complemented by an illustrated sheet which he will return to the reception, at the same time as the number of his room.

The text and the drawings of this sheet will indicate to him that he must open his door and position himself before its side so as to be able simultaneously to access the two sides of the lock. With his left hand, he will press on the internal electric button and with his right hand he will effect the required operations on the keyboard. Without releasing the pressure on the internal electric button, which would result in interrupting the operation and obliging him to begin again at the point where he left off, he will compose a secret code number of four digits, of his choice, on the decimal keyboard. After having successively pressed the four digits of the combination, he will press one of the specific buttons. The programming will thus be achieved and the new secret code inscribed in the memory in the place of the preceding number. The client will be able to renew as often as he desires this programming operation.

From the completed programming, the patron will be able to test his code number according to the method of use indicated on the external face of the lock. Without changing position, after having released the internal electric button, he will lock the door by pressing on the mechanical button placed at the center of the interior knob. He will then be able to verify that the exterior knob is blocked. To unlock it, he must first press one of the specific buttons. He will then enter his code number of four digits on the decimal keyboard. Next, he will press on one of the specific buttons, and simultaneously with this pressure he will perceive a slight clicking in the lock which indicates that the unlocking has been effected. The exterior handle will again be free, driving the bolt of the lock.

To lock his door, either when he is in the room, or when he leaves it, the patron must press on the mechanical button placed at the center of the interior handle. On the other hand, this latter will never be blocked, so that even when the door is locked, the exit from the room will always be free.

2. Usage by employees;

The administration of the establishment arranges nine secret code numbers which will permit them to realize a pyramidal hierarchization that is quite complete. Each person who needs to enter will be confided with a secret code number which he alone will know, with the responsibility for security. With the aid of his number, he and he alone will be able to open the doors of the rooms which he must access.

To unlock a door, the employee must use a procedure slightly different from that of the patron. Instead of beginning by pressing on one of the specific buttons, he will press first on the first number of his combination, an invariable number which always precedes the secret code of four digits. For example, the cleaning ladies will be allotted coded combinations beginning with the number 1 (first level of the hierarchization, the management having the number 9 corresponding to the highest level). The following operation is analogous to that of the patrons.

The programming of secret "service" code numbers must be effected by the person responsible for security or by a person delegated by him. The operation must be preceded by two simultaneous coded combinations of which the programming has been made in the manufacture and which will be able to be modified, if necessary, by disassembling the lock and replacing a programmable memory.

The exterior knob comprises in its center a lock core. The action of this latter take priority over the electronic functioning of the system.

The lock according to the invention is energized by two flat batteries.

The accompanying drawings, given by way of explanatory and non-limiting example, will permit an easy comprehension of the invention. They show a preferred embodiment according to the invention.

Figure 1:
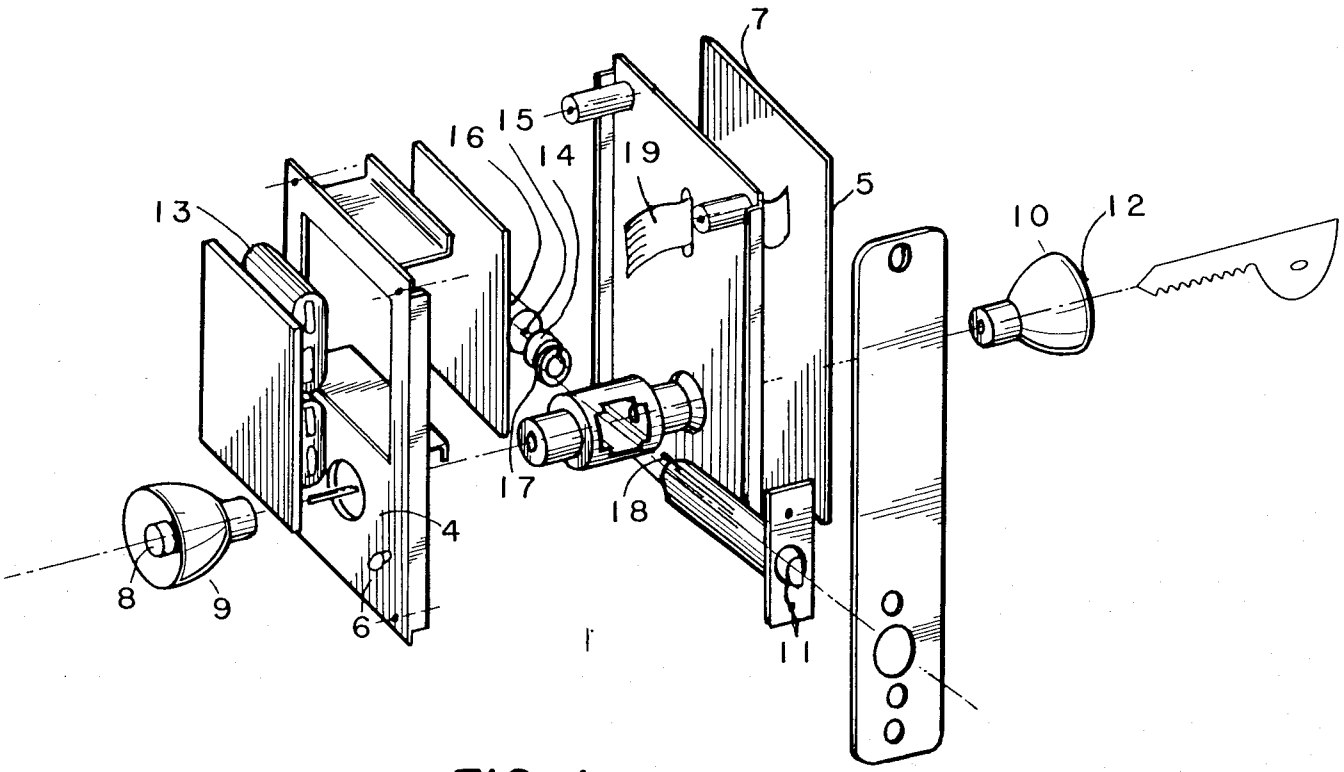
FIG. 1 is a view in perspective of the electromechanical lock with coded keyboard.
Figure 2:
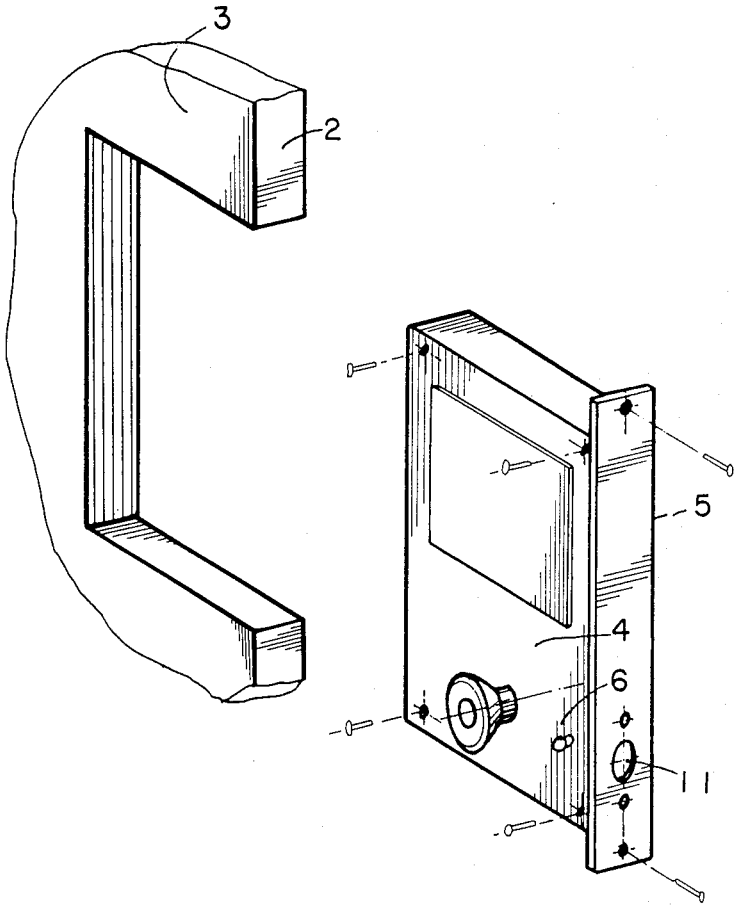
FIG. 2 is a view in perspective, of the electromechanical lock with coded keyboard, demonstrating its easy mounting for replacing an existing lock.
Figure 3:
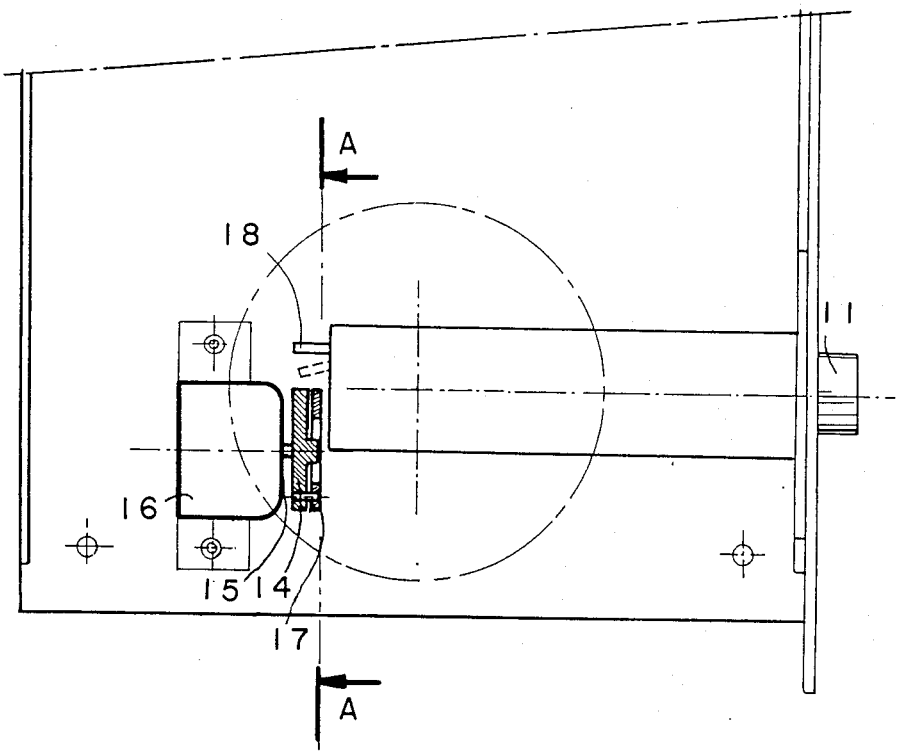
FIG. 3 is a view in lateral section of the lock taken at the level of the bolt axis and the shaft of the motor.
Figure 4:
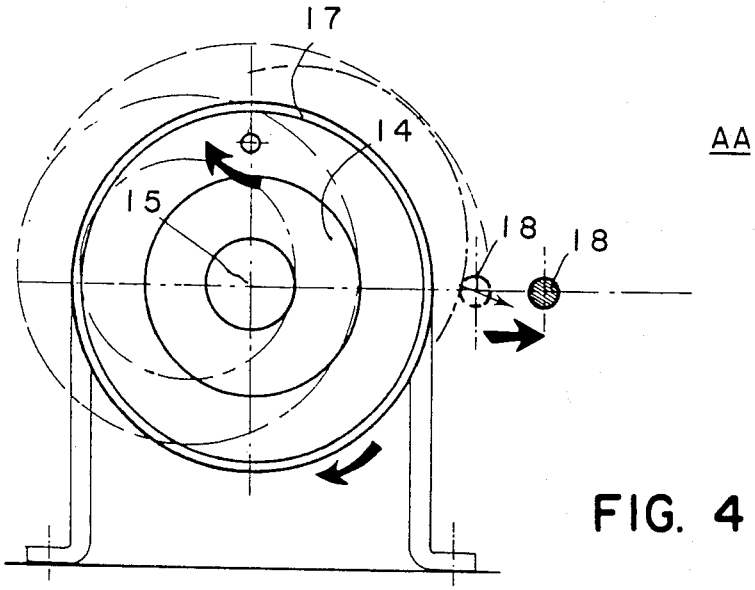
FIG. 4 is a sectional view according to the line A—A shown in FIG. 3.
Figure 5:
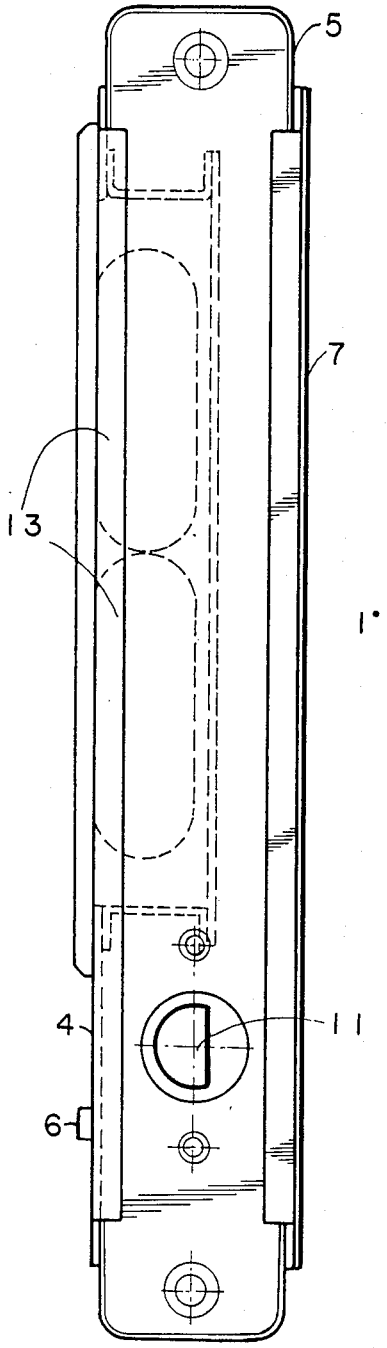
FIG. 5 is a side view of the lock, shown on the frame of the side of the bolt.
Figure 6:
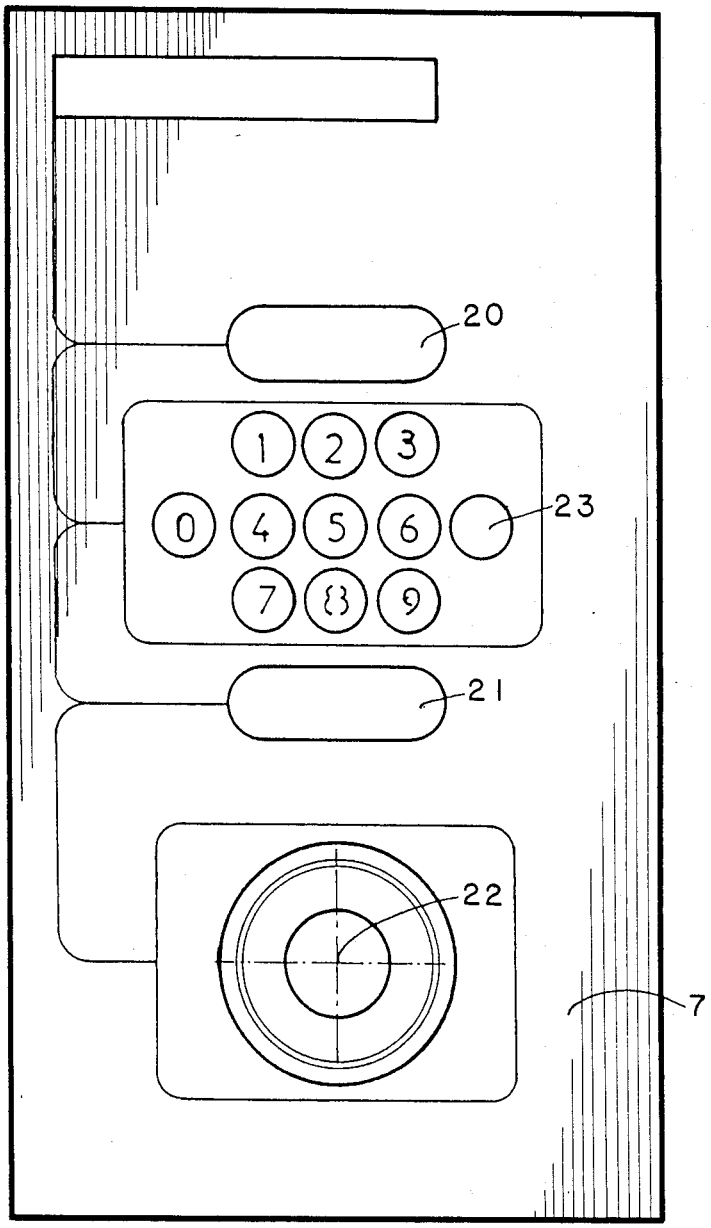
FIG. 6 is a view of the keyboard.

The process for using the lock according to the invention will permit a ready comprehension of the invention.

1. Process for usage by the patron;

The patron finds the door 3 of his room unlocked at the beginning of his stay. He must proceed to program his lock 1 according to the directions given on the text engraved on the internal face of this former. This method of use will be complemented by an illustrated sheet which he will return to the reception, at the same time as the number of his room.

The text and the drawings of this sheet will indicate that he must open his door 3 and position himself before its edge 2 so as to be able simultaneously to access both sides 4, 5 of the lock 1. With his left hand, he will press on the electric button 6 of the internal side of the door 3 and with his right hand he will effect the required operations on the keyboard 7. Without releasing the pressure on the internal electric button 6, which would have the effect of interrupting the operation and requiring him to begin again at the point of his departure, he will compose a secret code number of four digits, of his choice, on the decimal keyboard 7. After having successively pressed on the four digits of the combination, he will press on the specific button 20. The programming will thus be achieved and the new secret code inscribed in the memory in the place of the preceding number. The patron will be able to renew as often as he desires this programming operation.

From the programming effected, the client will be able to test his code number according to the method of use indicated on the external face 4 of the lock 1. Without changing position, after having released the electric internal button 6, he will lock the door 3 by pressing on the mechanical button 8 placed at the center of the interior knob 9. He will then verify that the exterior knob 10 is blocked. To unlock it, he must first press on the specific button 20. He will then enter his code number of four digits on the decimal keyboard. Next, he will press the specific button 20, and simultaneously with this pressing he will perceive a slight clicking in the lock 1 which indicates that the unlocking is effected. The external knob 10 will again be free, driving the bolt 11 of the lock.

To lock his door 3, either when he is in his room, or when he leaves it, the patron must press on the mechanical button 8 placed at the center of the interior knob 9. On the other hand, this latter will never be blocked, even when the door 3 is locked, so that exit from the chamber will always be free.

2. Usage by employees:

To unlock a door 3, the employee must first press the first number of his combination, an invariant number which always precedes the secret code of four digits.

For example, cleaning ladies will be allotted coded combinations beginning with the number 1 (first level of the hierarchization, the management having the number 9 corresponding to the highest level). The following operation is analogous to that of the clients.

The exterior knob 10 comprises at its center a lock core 12. The action of this latter takes priority over the electronic functioning of the system. These keys will not be distributed, but reserved for the management of security and used solely as a last resort in the case of electronic failure of the lock.

The lock according to the invention is energized by two flat batteries 13 of 4.5 volts. These batteries 13 permit an autonomous operation of greater than one year, under conditions of normal use. Their periodic replacement must be organized in a systematic manner.

PROCESS FOR PROGRAMMING "SERVICE" NUMBERS

1. Press the buttons for the first simultaneous coded combination: for example: 3, 6 and 9.

A perfect simultaneity, at the beginning of the action on each button is not necessary.

2. Press the buttons for the second simultaneous coded combination: for example: 1, 2, 4 and 8.

3. Verify that the red indicator 23, seen as transparent on the face before, is clear. If not, recommence the procedure at the beginning.

4. Enter the secret code number of four digits to be programmed, preceded by its order number: 1, 2, 3, 4, 5, 6, 7, 8 or 9; for example: 3 1515.

5. Press the specific button 21.

The nine numbers must be successively programmed, they must be followed each time by pressing the specific button 21.

6. The programming operation effected, press on the unmarked button 23, placed at the right of the decimal keyboard 7. The red indicator 22 is extinguished and the lock 1 is again usable.

PROCESS FOR UNLOCKING WITH A "SERVICE" NUMBER

1. Enter the five digits of the code number that have been confided to you, without pressing any of the specific buttons.

2. Press the specific button 21.

3. Use the knob 10 to open the door 3.

Don't forget to press the mechanical button 8, placed at the center of the interior knob 9, before leaving the room.

MEANS PERMITTING THE ELECTRIC UNLOCKING OF THE DOOR

The function to be exercised is analogous to that necessary for the unlocking of an electric latch: one must act on a trigger to liberate a mechanism, previously armed by a manual effort, which is displaced under the action of a spring. The universally adopted solution for realizing this function proceeds through the use of an electromagnet which acts directly, or indirectly, on the trigger. The energetic efficiency of this solution is extremely mediocre and the assemblies which permit it are generally fragile and quite weak.

The solution chosen by the inventors is an original solution which directly uses the shaft of an electric motor.

A disk 14 of plastic material is fixed concentrically with the shaft 15 of the motor 16 so as to be fast with it in rotation. A second disk 17, of metal so as to have a sufficient mass, is fixed to the first but in an eccentric manner this time. When the motor 16 is placed in rotation, the metallic disk 17, under the action of the centrifugal force, acts as an eccentric and comes to strike the trigger 18 so as to release it. This apparatus has the advantage of profiting from the electric efficiency of the motor 16, much greater than that of an electromagnet for a significant mechanical course, and does not require any permanent connection between the elements connected to the motor and the trigger. On the other hand, it permits automatically effecting several successive tests, if the first is not successful.

At the starting of the motor 16, this latter exerts no supplemental effort other than those required by the driving of the two disks 14, 17 to be exerted. The action on the trigger intervenes only after it has reached a sufficient speed, thus permitting to profit from the kinetic energy acquired. Whatever the angular position of the disks 14, 17 may be at the stop of the motor 16, the trigger 18 is freed by the refalling of the metallic disk 17, under the action of gravity, which permits rearming without difficulty the lock 1.

The electronic portion is not shown in the figures. The integrated circuits of other parts are connected by the lines 19 which are shown only as issuing from the keyboard 7.

I claim:

1. Electromechanical lock with coded keyboard comprising, on its interior face, a pushbutton (6) which permits programming the secret code of the user for passage and the secret code or codes for service and, on its exterior face (5), a coded keyboard (7), said lock comprising in addition to buttons corresponding to the normal buttons of a keyboard (7) at least specific button (20, 21) controlled to open the door (3) after having composed the program and/or for programming secret codes for service the electric unlocking of the lock using means (17) making use of an eccentric, actuated by an electric motor (16), which acts on a trigger (18) for unlocking, and the eccentric (17) is a disk mounted eccentrically on the shaft (15) of the electric motor (16); the rotation of the said shaft (15) causing the disk to turn, which, under the action of centrifugal force, strikes the trigger (18) to free a bolt.

2. Electromechanical lock with coded keyboard comprising, on its interior face, a pushbutton (6) which permits programming the secret code of the user for passage and the secret code or codes for service and, on its exterior face (5), a coded keyboard (7), said lock comprising in addition to buttons corresponding to the normal buttons of a keyboard (7) at least specific button (20, 21) controlled to open the door (3) after having composed the program and/or for programming secret codes for service the electric unlocking of the lock using a means (17) making use of an eccentric, actuated by an electric motor (16), which acts on a trigger (18) for unlocking, and to a disk (14) of plastic material fixed concentrically with the shaft (15) of the motor (16) so as to be fast with it in rotation, a second disk (17) having a sufficient mass is fixed in an eccentric manner and comprises said eccentric.

3. Electromechanical lock with coded keyboard comprising, on its interior face, a pushbutton (6) which permits programming the secret code of the user for passage and the secret code or codes for service and, on its exterior face (5), a coded keyboard (7), said lock comprising in addition to buttons corresponding to the normal buttons of a keyboard (7) at least specific button (20, 21) controlled to open the door (3) after having composed the program and/or for programming secret codes for service the electric unlocking of the lock using a means (17) making use of an eccentric, actuated by an electric motor (16), which acts on a trigger (18) for unlocking, and a disk (14) of plastic material fixed concentrically to the shaft (15) of the motor (16) so as to be fast with it in rotation; a second disk (17), of metal so as to have a sufficient mass, is fixed to the first, but in an eccentric manner, whereby when the motor (16) is caused to turn, the metallic disk (17), under the action of centrifugal force, acts as said eccentric and strikes the trigger (18) so as to free it.

4. Electromechanical lock with coded keyboard according to claim 3, in which:

at the stoppage of the motor (16), this latter exerts no supplementary effort other than that required to drive the two disks (14, 17); the action on the trigger occurs only when it has reached a sufficient speed, thus permitting benefitting from the kinetic energy acquired; whatever the angular position of the disks (14, 17) may be at the stoppage of the motor (16), the trigger (18), is freed by the falling of the metallic disk (17), under the action of gravity, which permits rearming without difficulty the lock (1).

* * * * *